US007484447B1

(12) United States Patent
Portmann

(10) Patent No.: US 7,484,447 B1
(45) Date of Patent: Feb. 3, 2009

(54) MINE CLEARING DEVICE INCORPORATING UNBIASED MOTION

(75) Inventor: Helmut Portmann, Panama City, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 457 days.

(21) Appl. No.: 11/254,121

(22) Filed: Oct. 17, 2005

(51) Int. Cl.
*F41H 11/12* (2006.01)

(52) U.S. Cl. ..... 89/1.13; 102/403

(58) Field of Classification Search ..... 102/504, 102/505, 513, 402, 403; 89/1.13, 37.12, 89/36.03; 180/8.7
See application file for complete search history.

(56) References Cited

U.S. PATENT DOCUMENTS 1,265,496 A * 5/1918 Pare ..... 440/99
3,951,069 A * 4/1976 Berlin et al. ..... 102/207
5,893,791 A * 4/1999 Wilkinson ..... 446/456
6,066,026 A * 5/2000 Bart et al. ..... 446/460
2005/0262995 A1* 12/2005 Kilkis ..... 89/1.13

* cited by examiner

*Primary Examiner*—Stephen M Johnson
(74) *Attorney, Agent, or Firm*—James T. Shepherd

(57) ABSTRACT

A mine clearing device comprises a substantially hollow body forming a cavity. An eccentric ballast is disposed within the cavity and is rotated by a motor powered by an internal power source, thereby imparting rotational motion to the device. A plurality of anti-axial projections of varying lengths and sizes are mounted on the outer surface of the body to interact with the terrain and, thus, impart unbiased motion to the body as it rotates and traverses a mine field. The outer surface of the body is made of blast resistant material. A shock absorbent material, disposed within the cavity, absorbs the explosive force of mines. Circuitry or a marker substance may be used to record or mark the path traveled by the device.

10 Claims, 3 Drawing Sheets

MINE CLEARING DEVICE INCORPORATING UNBIASED MOTION

STATEMENT REGARDING FEDERALLY SPONSORED RESEARCH OR DEVELOPMENT

The invention claimed and disclosed herein may be manufactured and used by, or on behalf of, the Government of the United States of America for government purposes without the payment of any royalties thereon or therefor.

BACKGROUND OF THE INVENTION

The present invention relates generally to mine clearing devices incorporating unbiased motion, more particularly to a mine clearing device comprising a blast-resistant body and having a plurality of projections to impart unbiased motion to the device.

There are, currently, millions of land mines remaining on the ground from past wars and scattered around dozens of countries, most of which, are poor, undeveloped countries with limited resources. Most of these mines are anti-personnel mines that maim rather than kill their victims. It has recently been estimated that over seventy people, mostly civilians, are injured by mines every day and that over five million new mines are manufactured and laid each year with very little expense.

Detection and clearing of these mines is a difficult problem. The most common techniques include either walking through an area with a metal detector or slowly and laboriously probing the ground manually to physically feel a buried mine, hopefully without detonating it. Unfortunately, these methods are extremely time-consuming and dangerous to the personnel involved. What is needed is a simple, safe and inexpensive system to find and detonate mines in a manner that can be mass produced and distributed in very large numbers and that can be easily used by uneducated and unsophisticated users with minimal logistical support or resources.

Recent technology solutions have focused on the increasing use of unmanned systems to locate and detonate land mines. Also, previously known mine clearing devices include devices that are attached to vehicles and set off mines and absorb the blast as the vehicle travels through the minefield. However, these devices, although effective at clearing mines, are too expensive, too complex, and too cumbersome to deploy affordably in effective numbers throughout the world.

BRIEF SUMMARY OF THE INVENTION

Accordingly, an object of the present invention is to provide an apparatus for clearing mines which is inexpensive and easy to operate.

Another object of the present invention is to provide an easily operated mine clearing device that can be used by persons, organizations, or countries with limited resources.

Another object of an embodiment of the present invention is to provide a more cost effective and simple means of marking areas traversed by a mine clearing device.

Another object of an embodiment of the present invention is to provide an apparatus for clearing mines that may be operated in areas where limited resources are available wherein the mine clearing device only requires battery power.

Other objects and advantages of the present invention will become more obvious hereinafter in the specification and drawings.

In accordance with one embodiment of the present invention, a device for clearing mines comprises a body having a continuous outer surface that forms a cavity, and a plurality of projections anti-axially disposed on the outer surface and adapted to interact with the terrain to impart unbiased motion to the body. A motor is disposed within the cavity of the body, a power source is disposed substantially within the cavity and coupled to the motor, and a ballast is coupled to the motor to impart rotational eccentric motion to the ballast within the cavity, thereby imparting rotational movement to the device. Preferably, the body of the device is composed of blast resistant material.

In accordance with one embodiment of the present invention, the mine clearing device further includes a shock absorbent material having a substantially continuous surface disposed in substantial contact with an inner surface of the shell and adapted for absorbing the shock of explosive forces acting upon the outer surface of the shell.

In another embodiment of the present invention, the cavity further contains a marker substance that may be expelled to mark the areas on the terrain traversed by the device.

In yet another embodiment of the present invention, circuitry is disposed substantially within the cavity and operable for tracking the path traveled by the device. Preferably, the circuitry transmits position data to a remote receiver. Additionally, circuitry may be disposed within the cavity that is operable for measuring the accelerations of the device and transmitting acceleration data to a remote receiver.

Also in accordance with the present invention, a method for clearing mines is provided, comprising the steps of installing a motor within the cavity of a substantially hollow body, coupling a power source and a ballast to the motor, thereby imparting eccentric motion to the ballast within the cavity when the motor is activated and, thus, imparting rotational movement to the body. The body has a plurality of anti-axially disposed projections on its outer surface and, preferably, is composed of a blast resistant material. The body is place in an area to be cleared of mines and the motor within the body is activated to impart eccentric motion to the ballast, thereby imparting rotational movement to the body and causing it to traverse the area to be cleared of mines. When the body comes into contact with a mine, the mine detonates and the blast energy from the mine's explosion that was imparted to the body is dispersed by converting it into kinetic energy. The body continues to randomly traverse the area to be cleared of mines and detonates mines in its path, as it is propelled by the kinetic energy in combination with the rotational movement of the body caused by the ballast.

Accordingly, the preferred embodiment of the present invention is directed to an apparatus and process that satisfies the need for a mine clearing device that is inexpensive, easy to operate, effective and safe. The present invention is further directed to an apparatus and method which combines the simple and reliable technology of an unbiased moving, autonomous, inexpensive body with an outer surface which will resist the explosive forces of mines, and a plurality of projections on the outer shell for imparting unbiased motion, therefore providing a simple, inexpensive, but effective mine clearing device.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts of the drawings and wherein.

DETAILED DESCRIPTION

Figure 1:
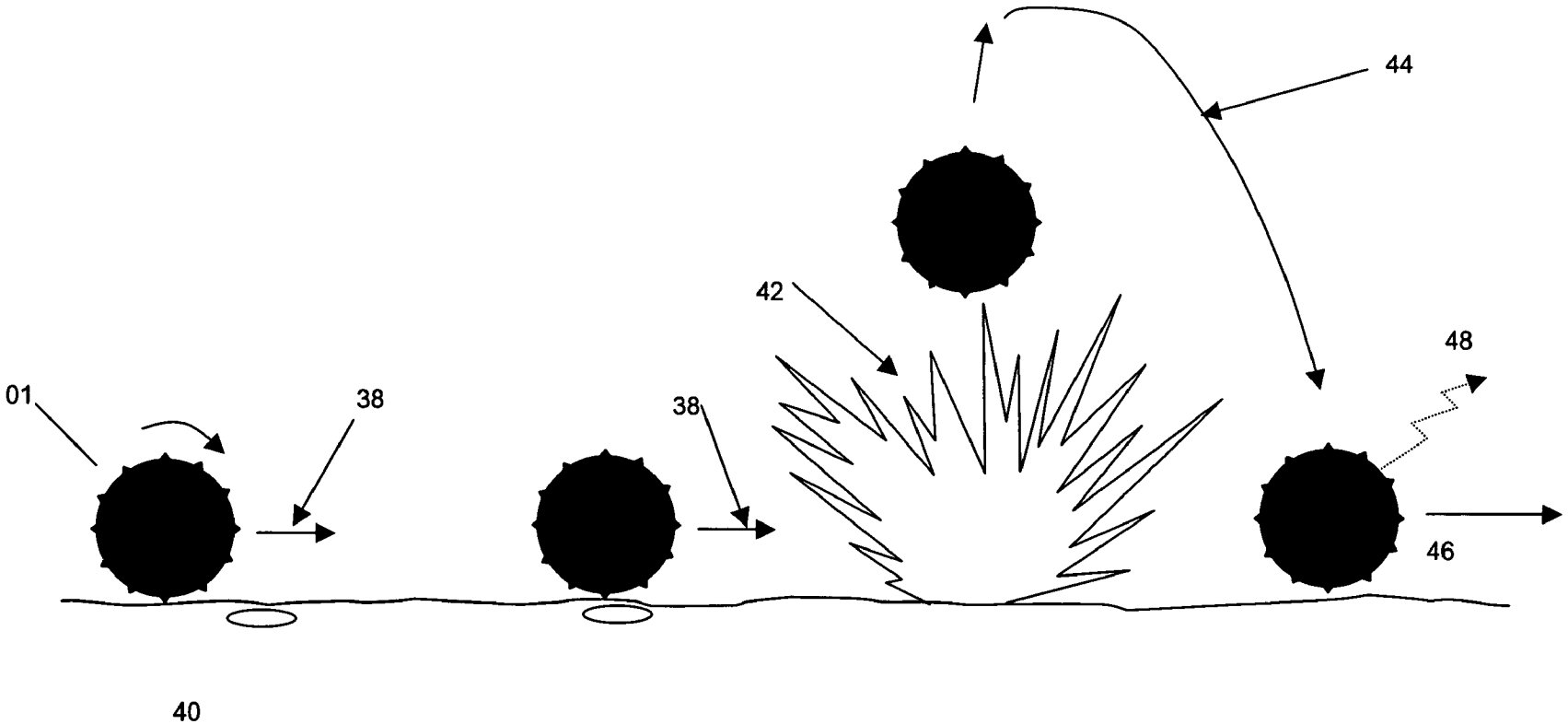
FIG. 1 illustrates a process for using the mine clearing device in accordance with an embodiment of the present invention.

As shown in FIG. 1, the preferred embodiment of this invention comprises a mine clearing device 01 that operates by traversing a minefield (shown as step 38), encountering mines 40, exploding the mines (step 42), resisting the blast of such mines and dispersing the kinetic energy (step 44), and then continuing to traverse the minefield (step 46).

Figure 2:
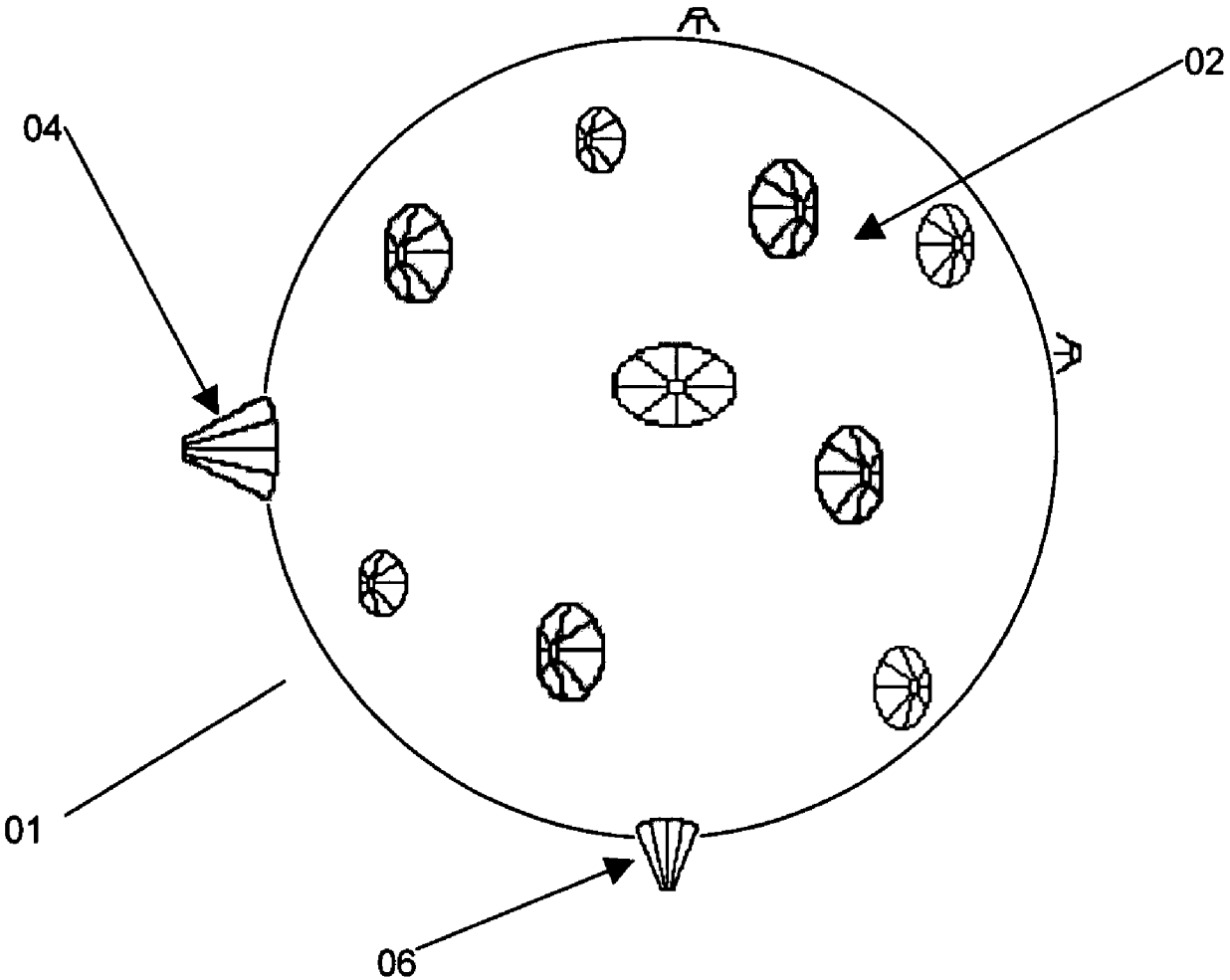
FIG. 2 shows a perspective view of the apparatus for mine clearing in accordance with an embodiment of the present invention.
Figure 3:
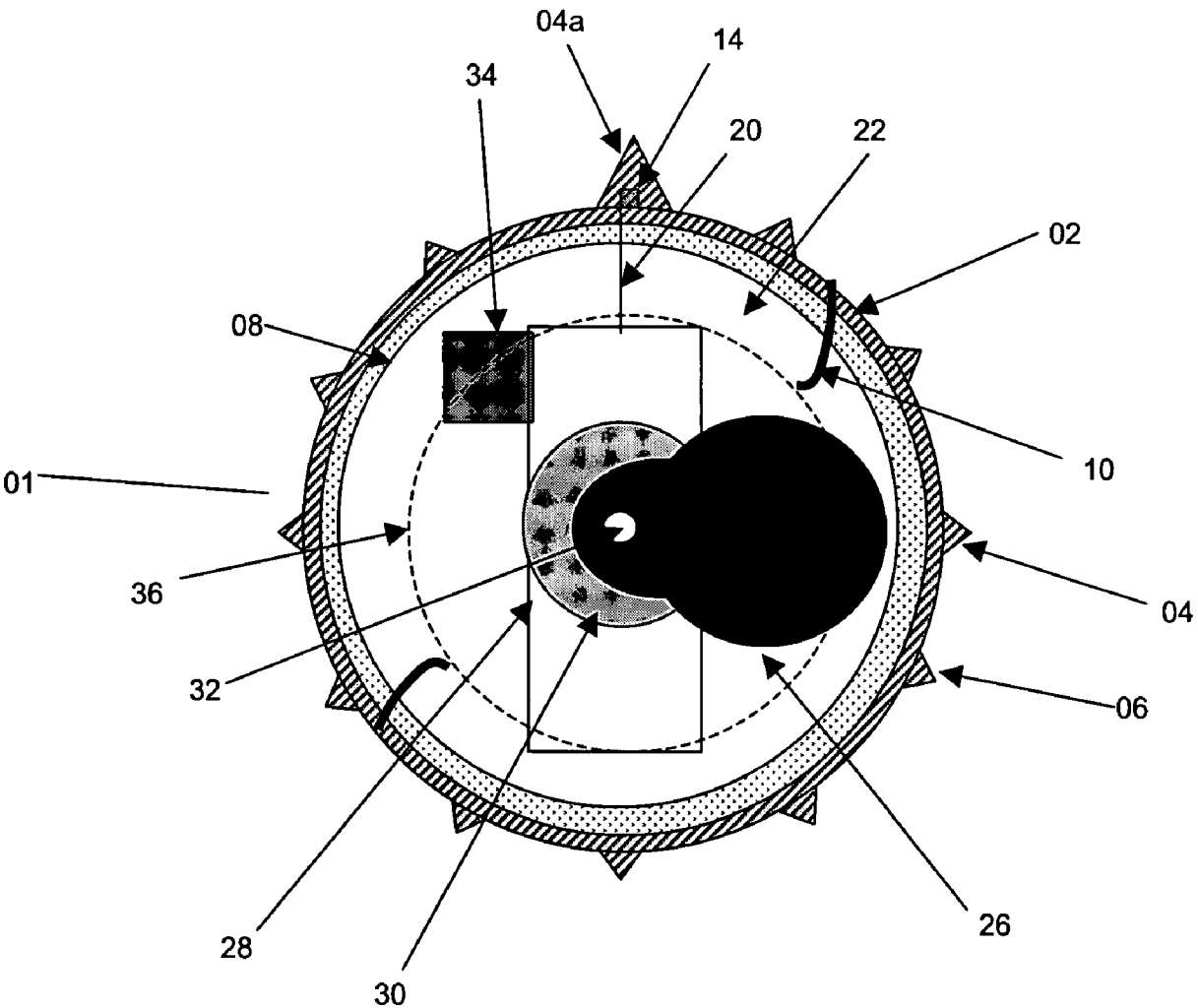
FIG. 3 shows a cross-section view of the apparatus for mine clearing, which incorporates an eccentric ballast to impart motion.

As shown in FIG. 3, mine clearing device 01 comprises a shell 02 forming a cavity 22. A plurality of anti-axial projections 04 and 06 extend from the surface of shell 02 (also shown in FIG. 2). Shell 02 contains a motor 28, which may be a direct current (DC) low voltage permanent magnet motor of either 24 or 12 volts disposed within internal cavity 22. Power source 34 is mounted inside cavity 22 and provides the necessary voltage to activate and operate the motor 28. A drive shaft 32 couples motor 28 to a ballast 26, and imparts rotational motion to ballast 26 when the motor 28 is activated. In operation, the rotational motion of ballast 26 changes the center of gravity of mine clearing device 01, thereby imparting rotational motion to it. This embodiment of the present invention may further comprise gears 30, operable with motor 28 in the conventional manner known to those skilled in the art to provide the appropriate torque, based on the weight of the mine clearing device 01 and the desired speed of motion.

In the preferred embodiment of the present invention, shell 02 is composed of a blast resistant material capable of resisting the explosive force of mines. The material may be composed of any suitable species of hard plastic, such as ABS (Acrylonitrile Butadiene Styrene), or may be composed of other similar blast resistant materials known to those skilled in the art. Shell 02 may be molded (shaped) to optimally hold and position the internal components, i.e., the motor, power source, and ballast; or the internal components may be fastened in place within cavity 22 by any mechanical fastener means known to those skilled in the art.

In the preferred embodiment, a shock absorbent material 08 is contained within, and is contiguous to, the inner surface of shell 02. Shock absorbent material 08 helps to absorb the shock from the explosion of mines that the mine clearing device 01 encounters. Preferably shock absorbent material 08 is made of any foam material, polyethylene or other substance or material which may be injected into shell 02 in order to coat the interior surface of the shell, or fill unused space within the shell. By filling the unused space in shell 02, the interior components will be fixed in place thereby insulating them from shock when the mine clearing device encounters a mine. However, shock absorbent material 08 must be sufficiently isolated from ballast 26 so that ballast 26 will remain free to rotate about shaft 32. Alternatively, layers of foam may be glued or otherwise adhered to the interior components, including motor 28 and power source 34. Suitable shock absorbent material may include any foam currently known to those skilled in the art capable of absorbing explosive shocks.

FIG. 3 also illustrates control 14 mounted on the outer surface of shell 02, enabling the user to activate and deactivate mine clearing device 01. A connector 20 couples control 14 to motor 28. Control 14 may comprise any known mechanical switch that operates to activate and deactivate an electric motor, or alternatively may comprise any electro-mechanical dial or equivalent device that enables selection of varying motor speeds. Preferably, control 14 is located under the base of one of the projections (shown as item 04*a* in FIG. 3) on the outer surface of shell 02. Projection 04*a*, covering control 14, provides structural protection to control 14 and shields it from exploding mines. Projection 04*a* may be hinged with a locking mechanism so that the projection may be swung open to provide access to control 14.

Referring to FIG. 2, projections 04 and 06 are disposed anti-axial to each other on the outer surface of shell 02. Projections 04 and 06 are preferably of varying sizes and are irregularly spaced to facilitate unbiased motion of mine clearing device 01 as it rolls across terrain under the rotational motion provided by the rotating ballast 26. The exact size and positioning of the projections 04 and 06 is dependent on the size of mine clearing device 01 and the randomness of motion desired, and can easily be selected with minimal experimentation.

In continued reference to FIG. 3, an embodiment of the present invention includes means for recording or marking areas that mine clearing device 01 has traversed. Recording or marking allows a user to ensure that an area has been cleared of mines. Accordingly, cavity 22 may contain a marker substance (not shown) that would be expelled from mine clearing device 01 to thereby mark the areas traversed by mine clearing device 01 on the terrain. The marker substance may be composed of powdered chalk, paint or any other similar substances known to those skilled in the art suitable to mark terrain. The marker substance may be contained in one or more marker containers 36 within cavity 22. One or more conduits 10 extend from marker container 36 through shell 02. When mine clearing device 01 is activated, the centrifugal force of its rotational movement will cause the marker substance to be expelled from marker container 36 to the outside environment via conduits 10. Alternatively, marker container 36 may be a pressure vessel that is charged with a compressed gas which is intermixed with the marker substance. A regulator (not shown) may be coupled to marker container 36 and conduits 10 to control the flow of the marker substance from out of the device. The regulator may be coupled to control 14 or have a separate control (not shown) mounted on the outer surface of shell 02. A separate marker fill tube (not shown) will extend from the outer surface of shell 02 to marker container 36 to allow the marker substance to be replenished.

Alternatively, circuitry (not shown) may replace the marker substance to track areas traversed by mine clearing device 01. Circuitry may include any Global Positioning System (GPS) circuitry and/or data-recording device and data transmission devices known to those skilled in the art. Additionally, circuitry may be used to measure the acceleration of mine clearing device 01 as it traverses terrain. Position and/or acceleration data may be recorded by the circuitry and transmitted to a remotely located user to provide useful information on the mine clearing device's 01 location and status. For example, when the acceleration of mine clearing device 01 is relatively high, it has likely encountered a mine.

The present invention is designed to be simple and easy to use. Preferably, the user first fills marker container 36 or cavity 22 with a marking substance through the marker fill tube. The user then places or propels mine clearing device 01 into the area to be cleared of mines. The user activates mine clearing device 01 by control 14. Mine clearing device 01 then autonomously traverses the terrain in random directions (shown as step 38 in FIG. 1). The rotational motion of the eccentric ballast weight 26 imparts rotational motion to mine clearing device 01; projections 04 and 06 cause the device to travel in a random, unbiased manner. When mine clearing device 01 physically encounters a mine 40, the mine will explode (step 42). Shell 02 resists the explosion from the mine and shock absorbent material 08 absorbs some of the explosive shock. The energy from the explosion will be dispersed as kinetic energy, causing mine clearing device 01 to be launched vertically and/or horizontally in either direction (step 44). Mine clearing device 01 then lands and continues to traverse the minefield (step 46), encountering and exploding mines until the minefield is cleared. During this process, the marking substance will be released, marking areas that mine clearing device 01 has traversed. An alternative embodiment of the present invention may involve transmitting location and/or acceleration data to a remote user (step 48). When all areas of the minefield have been traversed and marked, the area is clear of mines. The user may then recover mine clearing device 01. If the mine has been prematurely launched out of the area to be cleared, the user may return it to the desired area, reactivate it and restart the process described above.

The preferred method for clearing mines uses multiple mine clearing devices 01 simultaneously to clear the selected terrain of mines in a shorter period of time. Further, the area to be cleared may be cordoned off (not illustrated) by the user at a height that will prevent mine clearing device 01 from escaping the area to be cleared. Mine clearing device 01 will continue to traverse the minefield in an unbiased route until it encounters the cordons or other barriers that enclose the area to be cleared. It will then rebound off of the cordon and continue to traverse the enclosed area. By using cordons, the user may thereby confine mine clearing device 01 to a particular area, facilitating the expedient clearing of mines from the cordoned area.

The present invention thusly provides a solution to the need for an inexpensive mine clearing device for users having few fiscal and material resources at hand. Further, the present invention provides a convenient method to record the areas that have been cleared by use of a marking substance or circuitry. The present invention may be used alone or in multiples to safely and conveniently clear mines from a minefield. Further, the present invention requires no vehicle to use it, thereby reducing its operational expenses. Since the present invention operates autonomously and remotely, the explosive force of mines does not pose a risk of harm to personnel.

In this disclosure, there is shown and described only the preferred embodiment of the invention as well as some alternatives. However, it is to be understood that the invention is capable of use in various other combinations and environments and is capable of changes or modifications within the scope of the inventive concept expressed herein. Unless expressly stated otherwise, all the features described in this disclosure (including the accompanying claims, abstract and drawings) may be replaced by alternative features serving the same, equivalent or similar purpose. Thus, unless expressly stated otherwise, each feature disclosed is but an example of a generic species of equivalent or similar features.

I claim:

1. A device for clearing mines, comprising:

a shell having a continuous outer surface and an inner surface that forms a cavity;

a motor having a drive shaft disposed within said cavity;

a power source coupled to said motor;

a ballast coupled to said drive shaft, said ballast being sized and positioned within said cavity to rotate freely around said drive shaft;

a plurality of projections anti-axially disposed on said outer surface and adapted to interact with the terrain to impart unbiased motion to said shell when rotational motion is imparted to said shell; and means to activate said motor disposed on said outer surface, said means being in communication with said motor;

wherein at least one of said plurality of projections is of a different length than at least another one of said plurality of projections.

2. The mine clearing device of claim 1, wherein said plurality of projections are spaced irregularly around said outer surface.

3. The mine clearing device of claim 1, wherein said shell comprises a blast resistant material.

4. The mine clearing device of claim 1, wherein said means to activate is disposed on said outer surface beneath one of said plurality of projections, wherein said one of said plurality of projections is moveable to provide access to said means to activate.

5. The mine clearing device of claim 1, further comprising a shock absorbent material having a substantially continuous surface disposed in substantial contact with said inner surface of said shell.

6. The mine clearing device of claim 1, further comprising a marker container disposed within said cavity and at least one conduit coupled to and extending from said marker container through said shell, wherein said marker container contains a marking substance and said conduit is adapted to provide passage of said marking substance from said marker container to the outside environment.

7. The mine clearing device of claim 6, further comprising a tube coupled to said marker container and extending through said shell, said tube adapted to permit refilling of said marker container with said marker substance.

8. The mine clearing device of claim 1, further comprising circuitry disposed substantially within said cavity and operable for tracking the path traveled by said shell and transmitting position data to a remote receiver.

9. The mine clearing device of claim 8, further comprising circuitry disposed substantially within said cavity and operable for recording the accelerations of said shell and transmitting acceleration data to a remote receiver.

10. The mine clearing device of claim 1, further comprising circuitry disposed substantially within said cavity and operable for recording the accelerations of said shell and transmitting acceleration data to a remote receiver.

* * * * *